US005402952A

United States Patent [19]

Stahlecker et al.

[11] Patent Number: 5,402,952

[45] Date of Patent: Apr. 4, 1995

[54] TUBE COUPLING SYSTEM FOR A SPINNING OR TWISTING SPINDLE

[75] Inventors: Gerd Stahlecker, Eislingen Fils; Hans Braxmeier, Süssen, both of Germany

[73] Assignees: Fritz Stahlecker, Bad Uberkingen; Hans Stahlecker, Sussen, both of Germany

[21] Appl. No.: 159,304

[22] Filed: Nov. 30, 1993

Related U.S. Application Data

[63] Continuation of Ser. No. 944,325, Sep. 14, 1992, abandoned.

[30] Foreign Application Priority Data

Sep. 21, 1991 [DE] Germany ..... 41 31 498.0

[51] Int. Cl.[6] ..... B65H 75/30

[52] U.S. Cl. ..... 242/46.5

[58] Field of Search ..... 242/46.5, 46.2, 46.21, 242/46.3, 46.4, 46.6; 57/129, 130

[56] References Cited

FOREIGN PATENT DOCUMENTS 7330642 8/1973 Germany .
974732 11/1964 United Kingdom .
1090354 11/1967 United Kingdom .

*Primary Examiner*—Daniel P. Stodola
*Attorney, Agent, or Firm*—Evenson, McKeown, Edwards & Lenahan

[57] ABSTRACT

In the case of a tube coupling system for a spinning or twisting spindle, in the case of which cap-type buttons project away from the outer circumference and come to rest against the interior wall of the tube, it is provided to place in the hollow spaces formed by the cap-type buttons one body respectively with a given mass. Because of the centrifugal force exercised by the massive bodies, the buttons are pressed toward the outside during the rotation of the spindle and come to rest against the interior wall of the tube. During the stoppage of the spindle, no radial force is operative in the case of the tube coupling system so that an axial displacement of the tube, particularly the removal of a full package and the fitting of a new tube, are possible without the resistance of the tube coupling system.

16 Claims, 3 Drawing Sheets

TUBE COUPLING SYSTEM FOR A SPINNING OR TWISTING SPINDLE

This application is a continuation of U.S. Ser. No. 07/944,325, filed on Sep. 14, 1992, now abandoned.

The present invention relates to a tube coupling system for a spinning or twisting spindle, comprising button-type devices which project away from the tube outer circumference, can be moved inside radial guiding devices, and each comprise a hollow space.

From the German Patent Document DE-GM 7 330 642, a tube coupling system is known which essentially comprises three spring-loaded push-buttons which project away from the outside wall of the spindle top part and rest against the interior side of the tube. The button-type devices are constructed in the manner of a cap and form a cavity that is open toward one side. A flat coil spring is embedded in the hollow space of the cap-shaped button-type device, is supported against the spindle top part and presses the cap-shaped button-type devices radially toward the outside. This known construction of a tube coupling system has been manufactured in very large piece numbers and is customary today in practical applications. When the full package is withdrawn and a new tube is to be fitted on, the spring force, which is in effect at the caps, must be overcome. Particularly during automatic doffing operations, this has resulted in problems because the tubes must be pressed into a predetermined axial position by way of the resistance of the tube coupling system. It was found that, because of these problems, the doffing by means of automatic devices cannot be carried out reliably.

From the British Patent Document GB-PS 1 090 354, a tube coupling system is known, in the case of which radially shiftable button-type devices, which are mounted on the spindle top part, are pressed against the interior side of the tube by centrifugal force. It is a requirement that the button-type devices, which are made from a solid material, be introduced from the inside into the openings, which are provided in the lateral wall of the spindle top part, through a hollow space machined into the upper end face of the spindle top part. After the introduction of the button-type devices, the hollow space is closed off by a cover. This construction, which requires relatively high expenditures, has not found acceptance in practice.

In the case of the tube coupling system known from the British Patent Document GB-PS 974 732, it is provided to arrange three ball-shaped devices radially movably in a hollow space which is formed by the end face of the spindle top part and a cylindrical projection which is mounted at a distance from the latter. In the circumferential direction, the hollow space is closed off by a flexible ring, the ball-shaped devices being able to rest against the interior side of this ring. When the spindle is rotated, the ball-shaped devices are pressed toward the outside against the ring. This ring yields because of its flexibility and the ring is placed against the interior wall of the sleeve in the area where the ball-shaped devices rest against it.

This type of construction, which also requires relatively high expenditures, has the additional disadvantage that the centrifugal force is distributed in a non-uniform manner in the case of the flexible ring against which all ball-shaped devices of the tube coupling rest. Particularly when the spindle rotates without a tube, this may lead to considerable unbalanced masses. This construction has also not been accepted in practice.

It is an object of the present invention to provide a tube coupling system which is simple and reasonable in cost with respect to manufacturing, and in the case of which the removal and fitting-on of a tube can be carried out without the requirement to overcome a resistance emanating from the tube coupling system.

This object is achieved according to preferred embodiments of the invention in that a body with a given mass, which exercises a centrifugal force, is accommodated completely in the hollow space, along with a cap-shaped element.

In the case of the construction according to the invention, a radial force in the case of the button-type devices is exercised only when the spindle rotates. When the tube is fitted on and removed, a resistance emanating from the tube coupling therefore does not have to be overcome.

By means of the tube coupling system according to the invention, a good fixing of the tube is achieved in the radial as well as in the axial direction. As opposed to the case in which the button-type devices are operated by means of a spring pressure, the contact pressure of the button-type device, and therefore the reliability of the fixing, increases as the rotational speed of the spindle rises.

The manufacturing of the tube coupling system according to the invention is particularly easy. Instead of the known flat spring, a massive body is used which is entered into the respective hollow space existing in the case of the button-type devices.

Otherwise the same manufacturing process and the same tools are used as in the case of the manufacturing of the tube coupling system which is known from the German Patent Document DE-GM 7 330 642. The weight of the body is determined corresponding to the desired centrifugal force.

It is advantageous to use a simple ball-shaped device as the body which may, for example, be made of steel.

In an advantageous development of the invention, the dimensions of the body are such that its diameter is smaller than the inside diameter of the button-type device. The body can therefore move freely in the hollow space.

In addition, when the body is made of a non-flexible material, such as steel, the compressing of the button-type device in the lateral direction is not hindered. As will be described below, this compression may be necessary for the assembly of the tube coupling system.

In a further advantageous development of the invention, a bore is provided for guiding the button-type device which is inserted radially into the spindle. In the case of its end face facing the spindle shaft, the bore has an undercut. The bore as well as the undercut may be produced in a particularly simple manner. For the assembly, the button-type device can be pushed from the outside opening into the bore in a simple manner.

The undercut is used as a radial stop and as a securing device against a detaching of the button-type device in the radial direction, a corresponding counterface being provided in the case of the button-type device which comes to rest against the undercut.

In a further advantageous development of the invention, the guiding bore is provided with an undercut only along a portion of its front edge. This undercut is sufficient for use as the radial securing device for the button-type device. It may be produced particularly easily by the guiding of a milling tool, after this tool has first produced the cylindrical bore, in a back-and-forth movement in the radial direction with respect to this bore. In this case, the milling tool is fastened to the end face of a shaft which has a smaller diameter than the bore and the milling tool.

In a further advantageous development of the invention, the button-type devices are designed in the manner of caps the open end faces of which face the spindle shaft. As a result, a particularly cost-effective manufacturing of the button-type devices, for example, of sheet metal or plastic, is made possible in which case the hollow space is formed which is required for accommodating the massive body.

In this case, it is advantageous for the outer contours of the button-type devices to correspond at least approximately to the shape of the guiding devices.

It is advantageous to design the button-type devices in such a manner that their lateral walls, which are situated opposite the walls of the guiding devices, are elastically flexible. As a result, it becomes possible to compress the button-type devices and to insert them during the assembly operation through the outside opening of the guiding device until the radial securing means for the button-type device is reached inside the guiding device.

In addition, it is advantageous to provide the button-type devices in each case with an edge which is arranged at the open end facing the spindle shaft and extends at least along a portion of the circumference of the button-type device. After the assembly is completed, this edge will reach behind the undercut of the guiding device and serves as the stop and as the radial securing means of the button-type device inside the guiding device.

For increasing the flexibility of the button-type devices, recesses are provided in the case of the lateral walls of the button-type devices which each start from the open end face of the cap-shaped button-type devices.

In a further advantageous development of the invention, the button-type devices are, on the sides which face away from the spindle shaft, provided with profilings to which counterprofilings correspond. These counterprofilings extend into the coaxial direction on the interior wall of the tube. As a result, the securing of the tube in the radial direction is improved further.

Other objects, advantages and novel features of the present invention will become apparent from the following detailed description of the invention when considered in conjunction with the accompanying drawings.

BRIEF DESCRIPTION OF TEE DRAWINGS

DETAILED DESCRIPTION OF TEE DRAWINGS

Figure 1:
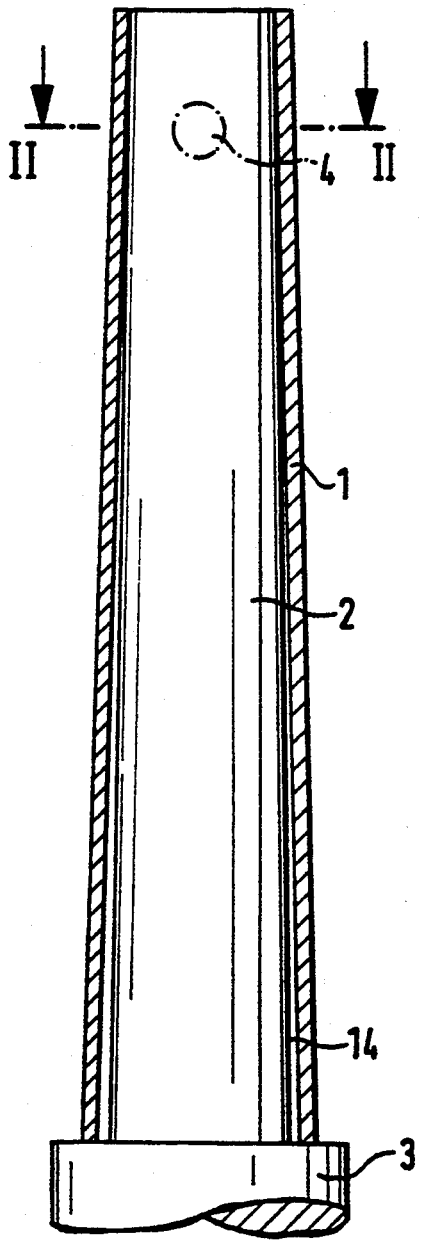
FIG. 1 is a view of the top part of a spindle with the tube coupling system according to the present invention schematically depicted only in outline form.

FIG. 1 is a longitudinal part sectional view of the spindle rotating part 2 of a-spindle. In its lower area, the spindle rotating part 2 is expanded to form a collar 3 which, in a manner that is known per se, is followed by the wharve, which is not shown, as well as by the spindle shaft. In the upper area of the spindle rotating part 2, a tube coupling system is arranged, only the button-type device 4 of this tube coupling system being illustrated by means of dash-dotted lines in FIG. 1.

A tube 1, of which FIG. 1 is a longitudinal view, is fitted onto the spindle rotating part 2. The button-type device 4 rests against the interior side of the tube 1 and secures it against axial and radial shifting. During the operation of the spindle, the tube 1 is taken along by means of the rotating spindle rotating part 2.

Figure 2:
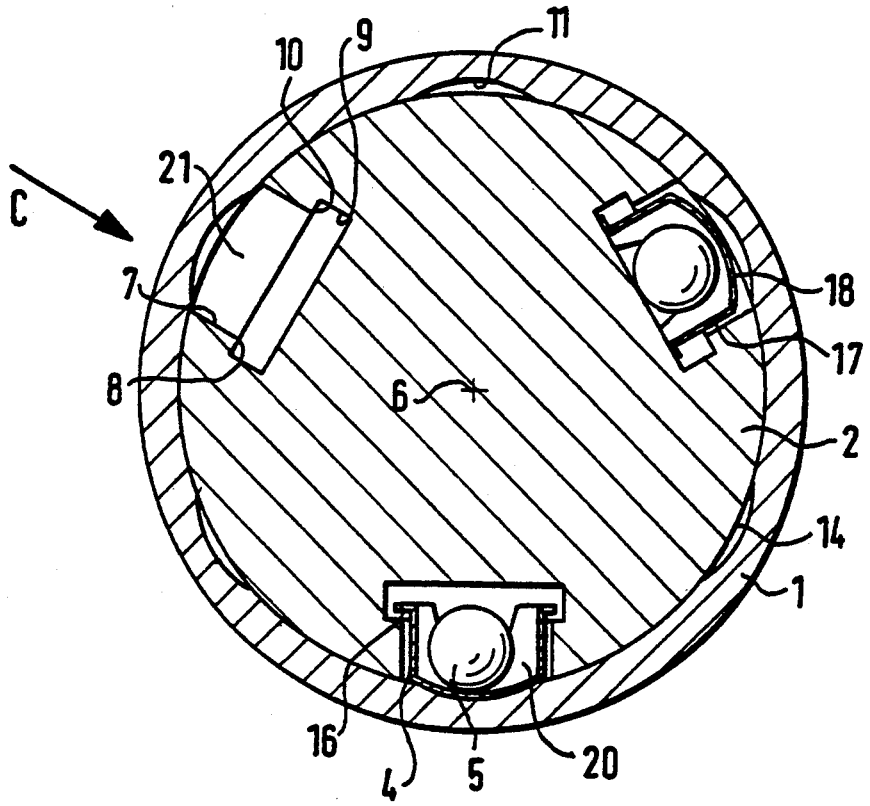
FIG. 2 is an enlarged sectional view along Line II—II of the tube coupling system of FIG. 1.

As illustrated in FIG. 2, the tube coupling system comprises the guiding channels or bores 21, the cap-shaped button type devices 4, and the massive bodies, which are developed as ball-shaped devices 5 and which are accommodated by the cap-shaped button-type devices 4. For the purpose of facilitating the understanding of this construction, one of the guiding bores 21 in FIG. 2 is shown without a button-type device and a ball-shaped device. In the case of a second guiding bore, the button-type device is shown in a condition in which it is embedded completely in the guiding bore. In the case of a third guiding bore, it is shown in a moved-out condition in which it rests against the tube. The guiding bore 21, the ball-shaped device 5 and the cap-shaped button-type devices 4 are dimensioned such that the button-type devices 4 are moveable completely into the guiding bores 21 in the illustrated embodiment. This allows the tube 1 to be fitted onto the spindle by its own weight. Since the devices 4 do not protrude over the outer surface of the spindle, there is no risk of the tube hitting a protruding device and then not fitting on completely.

Figure 7:
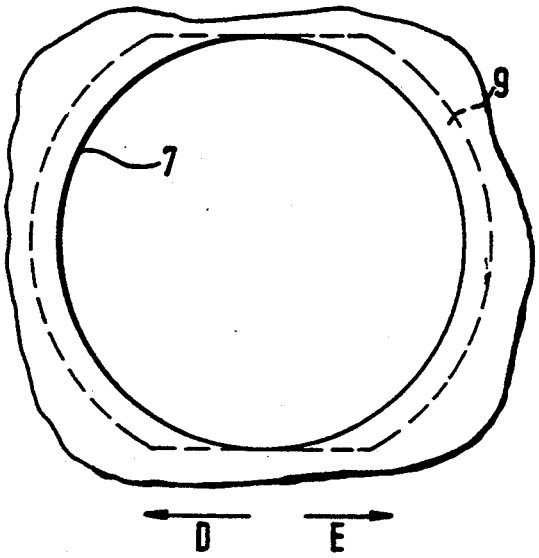
FIG. 7 is an enlarged view of a guiding device in the direction of the arrow C of FIG. 2.

The guiding bores 21 have the shape of cylindrical bores which, starting from the exterior wall 14, extend toward the spindle shaft axis 6. The cylindrical wall 7 of the guiding bore 21 ends at the front edge 8. At this front edge 8, the guiding bore 21 is expanded to an undercut 9 which, however, extends only along a portion of the circumference of the cylindrical wall 7 (compare FIG. 7).

In the embodiment of FIG. 2, the spindle rotating part 2 is provided with three of such guiding bores 21.

Figure 4:
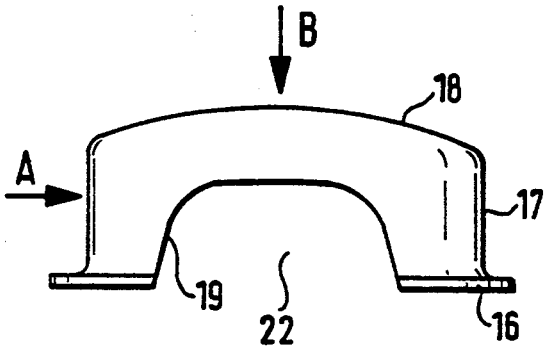
FIG. 4 is an enlarged representation of a cap-shaped button-type device of the tube coupling system of FIG. 2.
Figure 5:
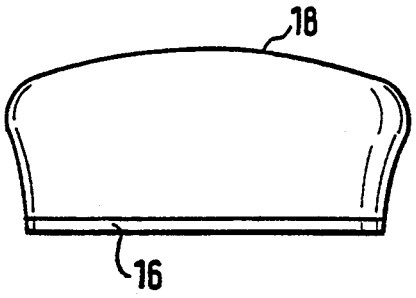
FIG. 5 is a view of the cap-shaped button-type device in the direction of the arrow A of FIG. 4.
Figure 6:
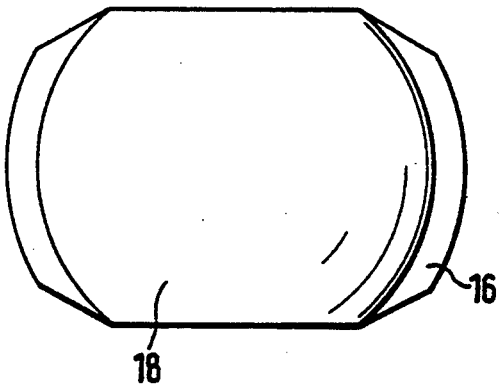
FIG. 6 is another view of the cap-shaped button-type device in the direction of the arrow B of FIG. 4.

In each of the guiding bores 21, a button-type device 4 is received which has a hollow space 20 in which the ball-shaped device 5 is accommodated. The button-type device 4 is constructed in the manner of a cap (compare FIGS. 4 to 6). It has an approximately cylindrical design, in which case end face 18 has an arched contour and the opposite end face 22 has an open design. A radially projecting edge 16 connects to the lateral walls 17 of the cap 4 in the case of the open end face 22, so that the cap 4 has an enlarged diameter in the area of the edge 16. The edge 16 extends only along a portion of the circumference of the cap 4.

The lateral wall 17 is interrupted by two mutually opposite recesses 19 which start from the open end face 22 and extend well along half of the length of the cap 4. The two mutually opposite recesses 19 interrupt the edge 16 so that two mutually opposite areas of the edge 16 are formed. The cap 4 consists of a thin material and can therefore be compressed at the mutually opposite areas of the edge 16.

In its hollow space 20, the button-type device 4 accommodates the ball-shaped device 5 (compare FIG. 2). The width of the hollow space 20 is slightly larger than the diameter of the ball-shaped device 5, so that the compression of the cap-shaped button-type device 4 will not be hindered by the ball-shaped device.

As illustrated in FIG. 2, the distance between the exterior borders of the mutually opposite edges 16 is larger than the diameter of the cylindrical bore of the guiding bore 21, but is smaller than the mutually opposite sides of the undercut 9. For assembly purposes, the cap 4 is pressed together at the mutually opposite areas of the edge 16 and is pushed into the guiding bore 21 through the opening of the cylindrical bore until the edge 16 arrives at the undercut 9. The pressure which is exercised on the mutually opposite sides of the cap 4 can then be terminated, so that the cap 4 resumes its original wide shape. The ball 5 is pushed into the guiding bore 21 together with the button-type device 4; however, the ball may also be pushed in earlier.

As demonstrated, the manufacturing and the assembly of the tube coupling system is very simple. According to a preferred simple method, a guiding bore 21 is placed in the exterior wall 14 of the spindle rotating part 2 by means of a milling cutter, in that, first, by advancing the rotating milling cutter in the radial direction to the spindle shaft axis 6, the cylindrical bore comprising the walls 7 is made which, subsequently, in the area facing the spindle shaft axis 6, is expanded to an undercut 9 by a linear moving of the milling tool in the direction of the arrows D–E, FIG. 7. Then the ball 5 and the cap-shaped button-type device 4 can be pushed into the guiding bore 21 without the aid of tools.

In the case of the embodiment illustrated in FIG. 2, the tube 1 is provided with longitudinal grooves 11. The contour of these longitudinal grooves 11 is adapted to the contour of the arched end face of the button-type device 4. The number of longitudinal grooves may correspond to the number of button-type devices. However, the number of longitudinal grooves 11 may also amount to a multiple of the number of button-type devices 4.

In the case of the embodiment illustrated in FIG. 2, three button-type devices 4 and six longitudinal grooves 11 are provided, in which case the button-type devices 4 are arranged at an angular distance of 120 degrees from one another, and the longitudinal grooves are arranged at a distance of 60 degrees from one another.

During the rotation of the spindle, a centrifugal force affects the ball-shaped devices 5. As a result, the button-type devices 4 are pressed against the interior wall of the tube 1.

The contact pressure exercised in this case is normally sufficient for a securing in the axial direction in the rotating direction.

In the case of the embodiment illustrated in FIG. 2, the button-type devices 4 of the tube coupling system arrive in the longitudinal grooves 11 of the tube 1 and enter a form-locking connection there. As a result, a securing of the tube 1 in the circumferential direction is achieved which is still better in comparison to the unprofiled walls of the tube.

Figure 3:
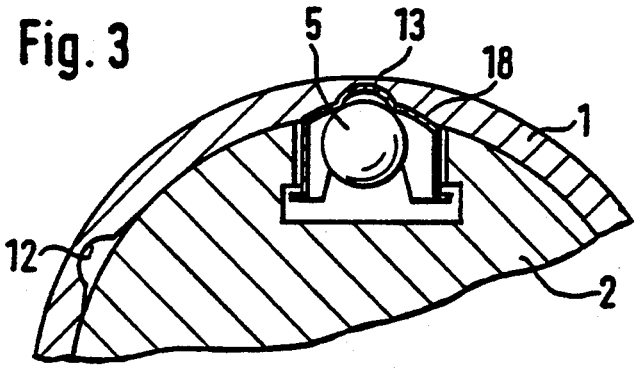
FIG. 3 is a partial view of another embodiment of a sleeve coupling system similar to FIG. 2.

A slightly different embodiment of the tube coupling system is illustrated in FIG. 3. In the case of this construction, the button-type device 4 is provided on its end face 18 with an additional projection 13 to which a longitudinal groove 12 of the tube 1 corresponds which is adapted to it in its contour. Apart from the above, the embodiment illustrated in FIG. 3 has the same construction as the embodiment illustrated in FIG. 2. During the rotation of the spindle rotating part 2, the projection 13 of the button 4 arrives in the longitudinal groove 12 of the tube.

When the tube 1 is pulled off, the undercut 9 of the guiding bore 21 is used as a stop and as a securing device against the falling-out of the button-type devices 4. When the tube 1 is pulled off, the edge 16 comes to rest against the end face 10 of the undercut 9. As a result, it is prevented that the button-type devices 4, as a result of the centrifugal forces affecting the ball-shaped devices 5, move still farther away from the spindle shaft axis 6 and are thrown out of the guiding bore 21.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A tube coupling system for coupling a tube at a spinning or twisting spindle which is rotatable about a spindle axis, comprising:

at least one recess extending radially inwardly from a spindle outer surface toward the spindle axis, said at least one recess being provided with an undercut section at its radially inner end, a cap-shaped element disposed in said at least one recess for movement radially of the spindle axis, said cap-shaped element being engageable at its radial inner end with the undercut to limit outward radial movement of the cap-shaped element during operation of the spindle, a body disposed in said at least one recess and being movable radially as a result of centrifugal forces during rotation of the spindle, said body being engageable with the cap-shaped element to thereby move the cap-shaped element radially outwardly to clamp an inside surface of a tube during rotation of the spindle, wherein the recess, the body and the cap-shaped element are dimensioned such that the cap-shaped element is movable completely into the recess, and wherein said body is housed in the space defined by the recess and cap-shaped element without any elastic pretensioning in either radial direction such that changing forces exerted on the inside surface of a tube are governed substantially exclusively by the rotational speed of the spindle.

2. A tube coupling system according to claim 1, wherein the cap-shaped element has radially extending approximately cylindrical lateral walls connected at an outer end by a contour cap section, said cap section being disposed to clampingly engage the inside surface of a tube during rotation of the spindle while said cylindrical lateral walls are continuously disposed within said recess.

3. A tube coupling system according to claim 1, wherein said body is a spherical ball.

4. A tube coupling system according to claim 1, wherein said body has a dimension transverse to a radius through the at least one recess which is smaller than a corresponding transverse dimension of inside surfaces of the cap-shaped element which surrounds the body.

5. A tube coupling system according to claim 1, wherein said cap-shaped element is elastically deformable and the respective body is sized and configured to permit detachable insertion of the cap-shaped element into the at least one recess with said body in place inside the at least one recess.

6. A tube coupling system according to claim 1, wherein the undercut is provided only along a portion of the circumference of the at least recess.

7. tube coupling system according to claim 1, wherein a plurality of said recesses and a corresponding plurality of said cap-shaped elements and bodies are provided.

8. A tube coupling system according to claim 7, wherein said bodies have smaller dimensions than corresponding inside dimensions of associated cap-shaped elements within which they are disposed.

9. A tube coupling system according to claim 7, wherein the cap-shaped elements are provided with profiling on their end faces facing away form the spindle axis, counterprofilings extending in the coaxial direction on an interior wall of the tube corresponding to these profilings.

10. A tube coupling system according to claim 7, wherein end faces of the cap-shaped elements facing the spindle axis are provided with an edge portion which extends at least along a portion of their circumference and reach behind the corresponding undercuts of the respective recesses.

11. A tube coupling system according to claim 7, wherein side walls of the cap-shaped elements are provided with recesses starting out from their open end face for accommodating insertions into the recesses.

12. A tube coupling system according to claim 7, wherein said cap-shaped elements are elastically deformable and the associated body is sized and configured to permit detachable insertion of the cap-shaped elements into respective areas of the recesses for engagement with the undercut, with the bodies in place inside the respective recesses.

13. A tube coupling system according to claim 12 wherein end faces of the cap-shaped elements facing the spindle axis are provided with an edge portion which extends at least along a portion of their circumference and reach behind the corresponding undercuts of the respective recesses.

14. A tube coupling system according to claim 12, wherein side walls of the cap-shaped elements are provided with recesses starting out from their open end face for accommodating insertions into the recesses.

15. A tube coupling system according to claim 12, wherein the cap-shaped elements are provided with profiling on their end faces facing away form the spindle axis, counterprofilings extending in the coaxial direction on an interior wall of the tube corresponding to these profilings.

16. A tube coupling system according to claim 12, wherein said bodies have smaller dimensions than corresponding inside dimensions of associated cap-shaped elements within which they are disposed.

* * * * *